US005384624A

United States Patent [19]

Kajiwara

[11] Patent Number: 5,384,624

[45] Date of Patent: Jan. 24, 1995

[54] IMAGE FORMING APPARATUS WITH AUTOMATIC CONTROL FOR DRAWING CASSETTE THEREFROM

[75] Inventor: Norio Kajiwara, Ichikawa, Japan

[73] Assignee: Canon Kabushiki Kaisha, Tokyo, Japan

[21] Appl. No.: 200,315

[22] Filed: Feb. 23, 1994

Related U.S. Application Data

[63] Continuation of Ser. No. 862,186, Apr. 2, 1992, abandoned.

[30] Foreign Application Priority Data

| | | | |
|---|---|---|---|
| Apr. 4, 1991 | [JP] | Japan | 3-097929 |
| Apr. 4, 1991 | [JP] | Japan | 3-097930 |
| Apr. 15, 1991 | [JP] | Japan | 3-108282 |

[51] Int. Cl.[6] ..... G03G 21/00

[52] U.S. Cl. ..... 355/207; 271/3.1; 271/213; 355/309

[58] Field of Search ..... 355/203, 204, 207, 209, 355/206, 308, 309, 314, 313, 316; 271/3.1, 213, 215, 264, 258–259, 265

[56] References Cited

U.S. PATENT DOCUMENTS

| | | | |
|---|---|---|---|
| 4,155,544 | 5/1979 | Scott | 271/145 X |
| 4,497,569 | 2/1985 | Booth, Sr. | 355/206 |
| 4,553,831 | 11/1985 | Dixon | 355/26 |
| 4,627,703 | 12/1986 | Suzuki et al. | 355/268 X |
| 4,684,235 | 8/1987 | Kohmoto et al. | 355/316 |
| 4,750,020 | 6/1988 | Ishizu et al. | 355/205 |
| 5,010,363 | 4/1991 | Higashio et al. | 355/206 |
| 5,021,824 | 6/1991 | Higashi et al. . | |
| 5,076,562 | 12/1991 | Sai et al. | 271/9 |
| 5,081,490 | 1/1992 | Waka® | 355/206 |
| 5,085,422 | 2/1992 | Sagara | 271/162 |
| 5,123,807 | 6/1992 | Nakaoda et al. | 271/189 |
| 5,126,989 | 6/1992 | Fukuchi et al. | 355/200 |
| 5,139,254 | 8/1992 | Yamashita et al. | 271/215 |
| 5,268,728 | 12/1993 | Sugiyama et al. | 355/319 |
| 5,294,106 | 3/1994 | Takagi et al. | 271/164 |

*Primary Examiner*—A. T. Grimley
*Assistant Examiner*—Thu Anh Dang
*Attorney, Agent, or Firm*—Fitzpatrick, Cella, Harper & Scinto

[57] ABSTRACT

An image forming apparatus includes a sheet mounting unit for accommodating sheets, a moving unit for automatically moving the sheet mounting unit between a feed position within a main body of the image forming apparatus for feeding the sheet and a drawn position wherein the sheet mounting unit is drawn from the main body of the image forming apparatus, wherein the moving unit includes a driving device for generating a driving force to automatically move the sheet mounting unit. Also provided are an image forming unit for forming an image on the sheet, a conveying unit for feeding and conveying a sheet from the sheet mounting unit at the feed position to the image forming unit, a sheet detection unit for detecting a stoppage of the sheet being conveyed by the conveying unit, and a control unit for controlling the moving unit to automatically move the sheet mounting unit from the feed position to the drawn position according to a detection by the sheet detection unit.

33 Claims, 11 Drawing Sheets

IMAGE FORMING APPARATUS WITH AUTOMATIC CONTROL FOR DRAWING CASSETTE THEREFROM

This application is a continuation of application Ser. No. 07/862,186, filed Apr. 2, 1992 now abandoned.

BACKGROUND OF THE INVENTION

1. Field of the Invention

This invention relates to an image forming apparatus, such as a facsimile apparatus, a copier, a laser-beam printer, an ink-jet printer or the like, and more particularly, to an image forming apparatus which includes a sheet mounting means for feedably mounting and accommodating cut sheets.

2. Description of the Related Art

Image forming apparatuses, such as facsimile apparatuses, copiers or the like, have been widely used. Such an image forming apparatus mounts a reading means for reading image information while conveying an original, and a sheet mounting means (hereinafter termed a "cassette"), such as a cassette, a tray or the like, for mounting and accommodating general-purpose-size sheets (cut sheets), in the main body of the apparatus, and further includes a recording means for performing recording while individually separating and feeding sheets from within the cassette.

When all the sheets within the cassette are used up, or when a sheet fed from the cassette jams while being conveyed, the operator is notified by means of display on a display unit or by a warning buzzer to urge replenishment of sheets or removal of the jammed sheet.

In the above-described conventional approach, however, when there is a display on the display unit notifying the operator if all of the sheets within the cassette are used up or if a sheet has jammed while being conveyed, the operator usually will not notice the display unless he actually looks into the display unit. Sounding the warning buzzer is in most cases merely a temporary action. Accordingly, in an apparatus operated by the user present in the vicinity thereof, the user can recognize exhaustion of sheets or jamming of a sheet and correct the problem. However, in an apparatus, such as a facsimile apparatus, which can operate even if the user is not present, the problem may not be called to the user's attention merely by means of the above-described display or buzzer, leaving the apparatus in a non-functioning state.

Particularly, in an apparatus, such as a copier, provided with an ApF (automatic document feeder), a sorter or the like, image recording is often performed as large amounts of sheets are fed in an unmanned state. Hence, if the recording operation stops, time is wasted and recording efficiency reduced. A facsimile apparatus not having a receiving memory cannot perform reception if jamming occurs. Even a facsimile apparatus having a receiving memory and a substitutional reception function cannot perform reception if the amount of received data exceeds the capacity of the memory.

In an apparatus which adopts a so-called front loading method wherein the direction of loading a cassette and the direction of feeding a sheet cross, when all the sheets within the cassette are used up, or when all sheet produces jamming, the rear end of the sheet in the course of being fed may be caught by the cassette, whereby the sheet may be damaged when the cassette is taken out, and the degree of jamming may be thereby increased.

SUMMARY OF THE INVENTION

It is an object of the present invention to provide an image forming apparatus wherein a person present in the vicinity can easily recognize exhaustion of sheets or occurrence of a jam, and can easily perform a recovery operation even if a particular notification is not provided.

This object is accomplished, according to one aspect of the present invention, by an image forming apparatus comprising sheet mounting means for accommodating sheets, moving means for moving the sheet mounting means between a feed position within a main body of the apparatus capable of feeding a sheet and a drawn position wherein the sheet mounting means is drawn from the main body of the apparatus by a predetermined amount, conveying means for feeding and conveying a sheet from the sheet mounting means at the feed position, image forming means for forming an image on the sheet conveyed by the conveying means, sheet detection means for detecting a stoppage of the sheet being conveyed by the conveying means, and control means for controlling the moving means so as to move the sheet mounting means from the feed position to the drawn position according to the detection by the detection means.

According to this configuration, when a sheet fed from the sheet mounting means stops while being conveyed by jamming or the like, the sheet mounting means is automatically drawn outside the apparatus. Hence, the operator can easily recognize a failure in conveying the sheet.

According to another aspect, the present invention relates to an image forming apparatus comprising sheet mounting means for accommodating sheets, remaining-amount detection means for detecting a remaining amount of the sheets accomodated in the sheet mounting means, moving means for moving the sheet mounting means between a feed position within a main body of the apparatus capable of feeding a sheet and a drawn position wherein the sheet mounting means is drawn from the main body of the apparatus by a predetermined amount in a direction crossing a sheet feeding direction, image forming means for forming an image on a sheet fed from the sheet mounting means, sheet detection means for detecting stoppage of the sheet being conveyed before the sheet is completely fed from the sheet mounting means, and control means for controlling the moving means so as to move the sheet mounting means from the feed position to the drawn position if the sheet detection means does not detect a stoppage of the sheet when the remaining-amount detection means has detected that the remaining amount of the sheets accommodated in the sheet mounting means is equal to or less than a predetermined amount, and to inhibit the movement if the sheet detection means has detected a stoppage of the sheet.

According to this configuration, when the amount of sheets accommodated in the sheet mounting means is equal to or less than the predetermined amount and sheets must be replenished, the sheet mounting means is automatically drawn, whereby the operator can be easily notified of the fact. At that time, if a sheet has jammed in the course of being fed from the sheet mounting means, the sheet may be damaged, or the the sheet may be caught by the sheet mounting means when the sheet mounting means is drawn, whereby the sheet mounting means cannot be drawn, since the direction of feeding the sheet is transversal relative to the direction of drawing the sheet mounting means. However, by not drawing the sheet mounting means when the sheet detection means has detected a stoppage of the sheet, it is possible to prevent the above-described troubles.

In order to move the sheet mounting means to the drawn position when all the sheets are used up, a rotation driving means, such as a motor or the like, may be used. Alternatively, the elastic force of a spring in the direction of torsion thereof may be charged, and the charged elastic force may be used.

DETAILED DESCRIPTION OF THE PREFERRED EMBODIMENTS

An explanation will now be provided of an image forming apparatus according to an embodiment of the present invention with reference to the drawings. In the present embodiment, an explanation will be provided of a facsimile apparatus as the image forming apparatus.

Figure 1:
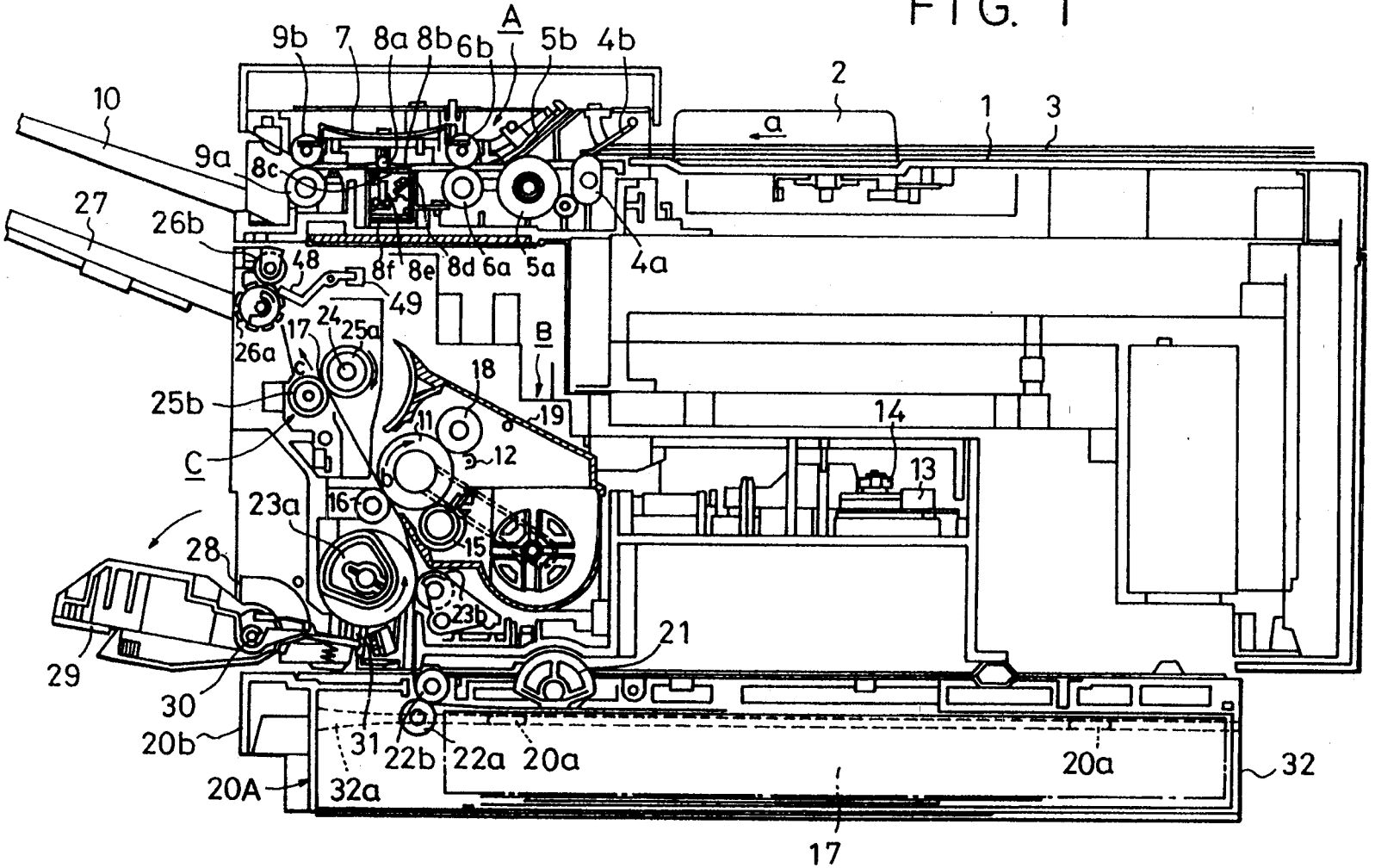
FIG. 1 is a vertical cross-sectional view of an image forming apparatus according to a first embodiment of the present invention.
Figure 2:
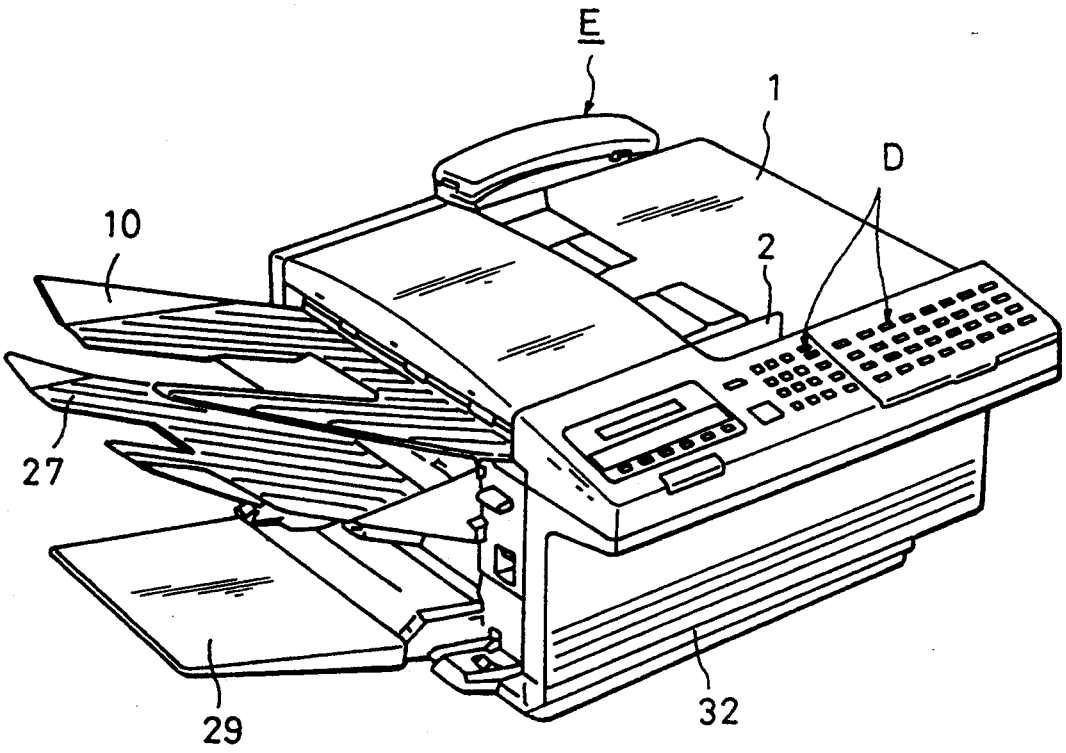
FIG. 2 is a perspective view of the entire image forming apparatus shown in FIG. 1.
Figure 3:
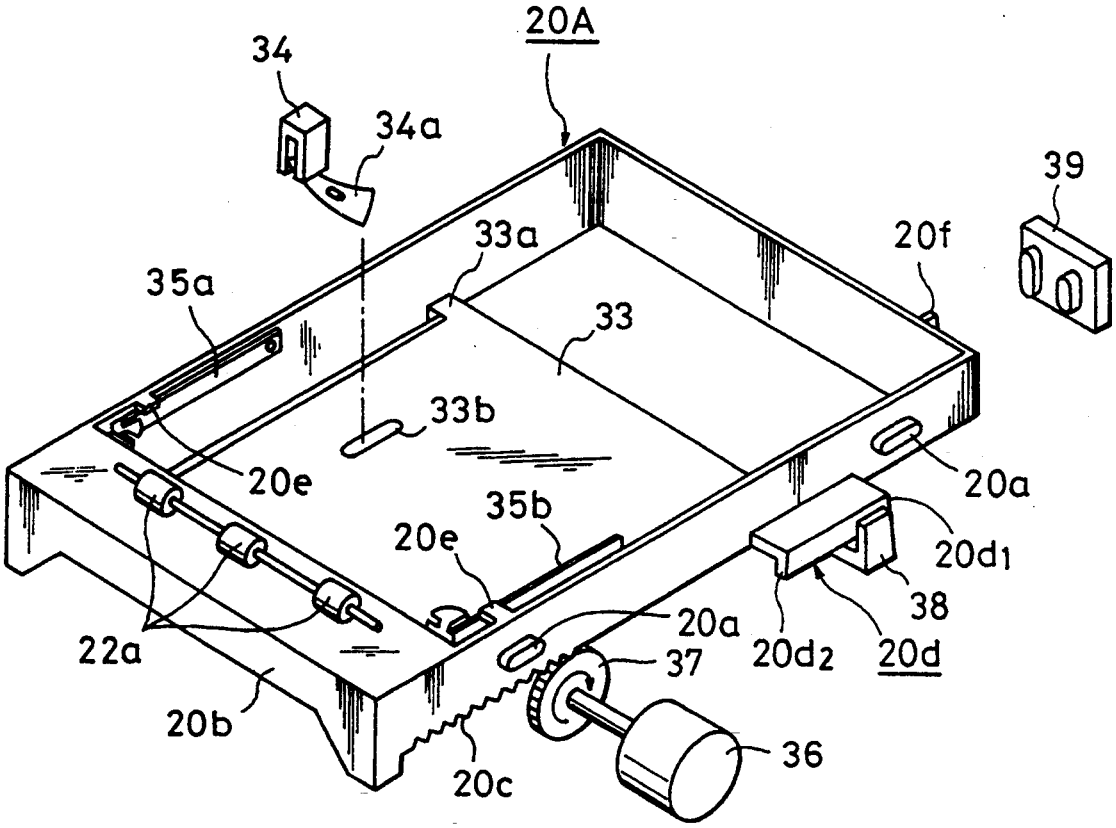
FIG. 3 is a perspective view of a cassette provided in the image forming apparatus shown in FIG. 1.
Figure 4:
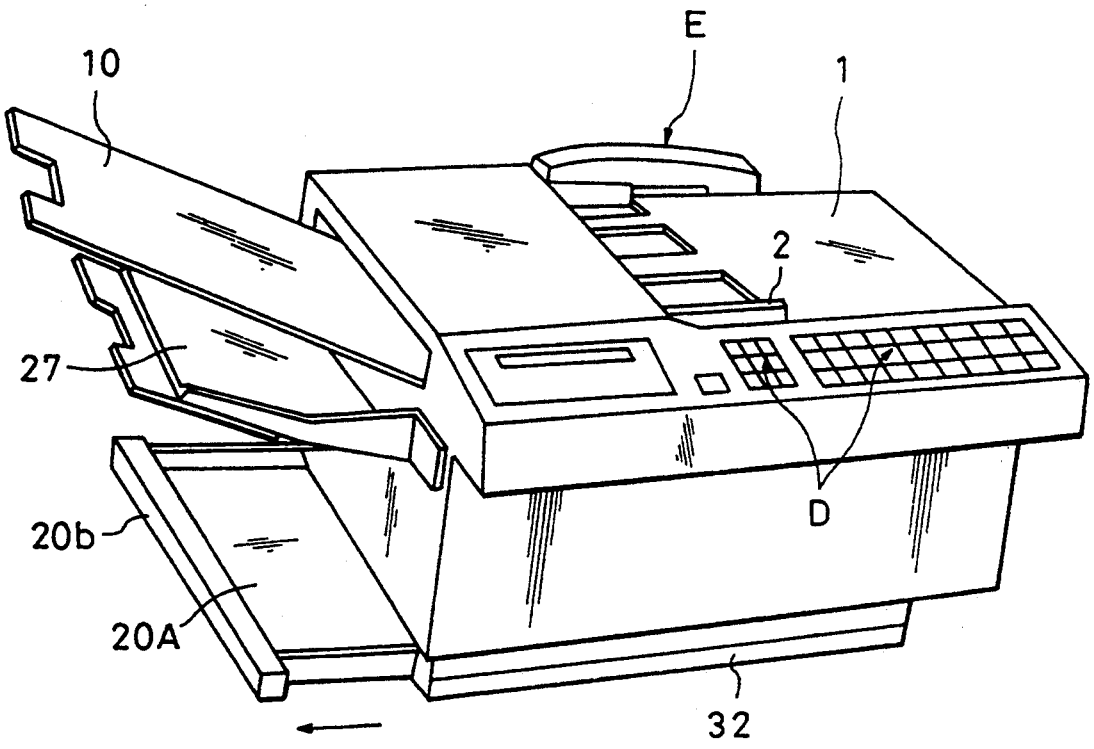
FIG. 4 is a perspective view showing a state of the cassette shown in FIG. 3 drawn from the main body of the apparatus.

FIG. 1 is a cross sectional view showing the schematic configuration of the facsimile apparatus. FIG. 2 is a perspective view of an external appearance of the apparatus. FIG. 3 is a perspective view showing the configuration of a cassette, serving as a sheet mounting means. FIG. 4 is a diagram illustrating a state of the drawn cassette.

First, the schematic configuration of the facsimile apparatus will be explained with reference to FIG. 1. An original reading means A reads information described on an original, converts the read information into electrical signals, and transmits the signals to a predetermined recording system. A recording means B records an image on a conveyed sheet in accordance with the image information. A feed means C includes a cassette 20A which feedably mounts and accommodates sheets, which can draw a sheet in a direction parallel to the direction of feeding the sheet, and which feeds sheets 17 mounted and accommodated in the cassette 20A to the recording means B. In FIG. 2, an operation panel D includes switches for assigning the number of sheets on which recording is to be performed, and switches for setting recording density, a transmission switch and the like. There is also shown a telephone set E.

The configuration of each unit of the facsimile apparatus will now be sequentially explained.

Original Reading Means

As shown in FIG. 1, in the original reading means A, an original mount 1 is formed at the udder surface of the apparatus. Sheets of an original 3 stacked on the original mount 1 with the image surfaces face-down, and, guided by side guides 2, are subjected to preliminary conveyance by a preliminary-conveyance roller **4*a* and a dressing member 4*b* in pressure contact therewith. Starting from the lowermost sheet, the originals 3 are individually separated by a separation roller 5*a* and a member 5*b* in pressure contact therewith, and are fed in the direction of arrow a (to the left side of the main body of the apparatus). Each of the separated and fed sheets of the originals 3 is conveyed by a feed roller 6*a* and a pinch roller 6*b* in pressure contact. Pinch roller 6*b* is urged toward feed roller 6*a* by a spring 7. The surface of the sheet is pressed against reading glass 8*c* by a pressing member 8*b* made of a white polyester film downwardly pressed by a weight shaft 8*a*, and is irradiated by light from a light-emitting member 8*d*, such as an LED (light-emitting device) or the like, when the sheet passes through the glass 8*c*. The light reflected by the surface of the sheet is imaged onto a photoelectric conversion device 8*f*, such as a CCD (charge-coupled device) or the like, via a lens 8*e*, whereby the image on the sheet is converted into electric signals. A contact-type reading sensor which uses a short-focal-length imaging lens is used as the lens 8*e***.

The sheet of the original 3 whose image is read by the above-described optical system is discharged onto an original discharge tray 10 mounted on the left side of the main body of the apparatus by a discharging roller **9*a* and a pinch roller 9*b* in pressure contact therewith. Pinch roller 9*b* is urged toward discharging roller 9*a* by the spring 7**.

Recording Means

The recording means B adopts the same configuration as a laser-beam printer. That is, a charger 12 disposed around a photosensitive drum 11 rotating in the direction of arrow b charges the surface of the drum 11. Light from a laser oscillator 13 oscillating a laser beam in accordance with image information is reflected by a polygon mirror 14. The reflected light exposes the rotating drum 11 to form an electrostatic latent image, which is visualized into a toner image by a developing unit 15 using toner. The toner image is transferred onto the sheet 17 conveyed between the photosensitive drum 11 and a transfer roller 16 in pressure contact therewith to perform recording. After transferring the toner image, the photosensitive drum 11 is cleaned by a cleaning member 18.

The photosensitive drum 11, the charger 12, the developing unit 15 and the cleaning member 18 are accommodated within a recording cartridge 19, which is detachably accommodated in the main body of the apparatus, as will be described later.

Feed Means

Next, an explanation will be provided of the feed means C for feeding the sheet 17. The cassette 20A, serving as the sheet mounting means for mounting and accommodating the sheets 17 is detachably mounted on a lower portion of the main body of the apparatus. As shown by arrow c in FIG. 1, the sheets 17 are individually fed by a semicircular feed roller 21 from the uppermost sheet. Each of the sheets 17 is conveyed while being registered by a pair of cassette conveyance rollers 22a and 22b which are in pressure contact with each other, is further conveyed by a pair of conveying rollers comprising a driving roller 23a and a pinch roller 23b in synchronization with the rotation of the photosensitive drum 11, and is subjected to image recording while passing between the photosensitive drum 11 and the transfer roller 16. Heat and pressure are applied to the sheet 17 after recording when it passes between a fixing roller 25a incorporating a heater 24, and a dressing roller 25b in pressure contact with the fixing roller 25a to fix the toner image. The sheet 17 on which the transfer image is fixed is discharged onto a sheet discharge tray 27 by a pair of discharging rollers 26a and 26b.

A jam detection actuator 48 and a jam detection sensor 49, serving as detection means for detecting a failure in conveying the recording sheet 17, are provided at a side upstream from the pair of discharging rollers 26a and 26b in the sheet conveying direction. The jam detection sensor 49 is in an off-state by being obturated by the jam detection actuator 48 when the sheet 17 is absent, and is in an on-state when the sheet 17 passes through the jam detection actuator 48.

In FIG. 1, a manual insertion port 28 is formed at the left side of the main body of the apparatus, and a manual insertion tray 29 for supplying the sheets 17 is mounted on the manual insertion port 28. The manual insertion tray 29 is rotatably mounted around a shaft 30. In operation, as shown in FIG. 1, the manual insertion tray 29 is tilted, and the sheets 17 are mounted thereon and fed through the manual insertion port 28. Each sheet 17 is separated by a separation member 31 which is in pressure contact with the driving roller 23a, and each sheet 17 is fed to the recording position by the pair of conveying rollers 23a and 23b.

As described above, the cassette 20A is accommodated in the lower portion of the main body of the apparatus so as to be drawable in parallel with the direction of feeding the sheet 17. As shown in FIG. 1, slide projections 20a protrude at the both outer sides of the receptacle of cassette 20A. A cassette accommodating unit 32 having an opening is formed at the original-discharging side (the left side in FIG. 1) in a lower portion of the apparatus. Guide grooves 32a, in which the slide projections 20a can be slidably fitted, are formed in inner walls of the cassette accommodating unit 32.

Accordingly, the cassette 20A can be set by fitting the slide projections 20a into the guide grooves 32a from the opening formed at the left side in FIG. 1. The cassette 20A can be taken out by grasping a handle 20b formed on the cassette 20A and drawing the cassette 20A to the left side in FIG. 1.

Next, the structure of the cassette 20A will be explained in detail with reference to FIG. 3. An inside plate 33 for mounting the sheets 17 is provided so as to be rotatable around a fulcrum 33a at a base portion of the cassette 20A. The inside plate 33 is configured so as to be upwardly driven from the back side by a lever or the like (not shown) when the cassette 20A is inserted into the cassette accommodating unit 32.

A sensor 34 detects the presence/absence of the sheets 17 mounted on the inside plate 33. An actuator 34a for the sensor 34 is in a state of contacting the sheets 17 mounted on the inside plate 33 and interrupting the sensor 34 (an off-state). A hole 33b is provided at a predetermined position of the inside plate 33. When all the sheets 17 on the inside plate 33 are used up, the actuator 34a drops into the hole 33b, whereby the photosensor 34 is turned on, and the absence of the sheets 17 can be thereby detected. Sensor 34, actuator 34a and hole 33b together function as remaining-amount detection means. The sheets 17 mounted on the inside plate 33 are individually separated and fed from the uppermost sheet by separation pieces 35a and 35b and stoppers 20e provided at inner walls of the cassette 20A. In place of the photosensor 34 for detecting the presence/absence of the sheets 17, a sensor for generating a signal when the amount of the mounted sheets 17 reaches a predetermined amount (also functioning as a remaining-amount detection means), or the like may be used.

A rack 20c is formed at a lower portion of a side of the cassette 20A, and a pinion 37 rotatably driven by a motor 36 meshes the rack 20c. By rotating the motor 36 in the forward or reverse direction, the cassette 20A can be drawn from or accommodated in the main body of the apparatus. An actuator 20d having an L-shaped cross section protrudes over a predetermined length (from end portion $20d_1$ to end portion $20d_2$) at a side of the cassette 20A. A photosensor 38 is provided in the moving range of the actuator 20d.

A projection 20f protrudes at the rear side of the cassette 20A, and a sensor 39 for determining the size (B4 size, A4 size or the like) of the cassette is provided at a position corresponding to the projection 20f.

When accommodating the cassette 20A in the main body of the apparatus, the sheets 17 are set within the cassette 20A, and the cassette 20A is inserted into the cassette accommodating unit 32. The cassette 20A moves while the slide projetions 20a are guided by the guide grooves 32a. If the end portion $20d_1$ of the actuator 20d reaches the photosensor 38, the motor 36 rotates in a clockwise direction. If the cassette 20A is partially inserted into the cassette accommodating unit 32, the rack 20c meshes the pinion 37, whereby the cassette 20A is automatically inserted. If the cassette 20A moves and the end portion $20d_2$of the actuator 20d reaches the photosensor 38, the projection 20f contacts the sensor 39, and the movement of the cassette 20A stops. At that time, since a rotational load from the motor 36 is applied to the cassette 20A, the cassette 20A is fixed without running out of the cassette accommodating unit 32 due to a reaction. Although, in the present embodiment, the cassette 20A is fixed after being mounted on the cassette accommodating unit 32 by the load of the motor 36, the cassette 20A may be fixed by providing a fixing means utilizing, for example, engagement between a leaf spring and a recess.

Next, an explanation will be provided of a jam detection operation for the sheet 17. If the time for conveying the sheet 17 from starting the feed roller 21 until the sheet 17 reaches the jam detection actuator 48 exceeds a predetermined time, it is determined that the sheet 17 was not fed from the cassette 20A or that a jam occurred in the image transfer or fixing process. If the turning-on time of the jam detection sensor 49 exceeds a time corresponding to the length of the sheet 17, as indicated by a size detection signal from the cassette 20A, it is determined that the sheet 17 jammed during the discharging operation.

At that time, if the motor 36 is rotated in a counterclockwise direction, the cassette 20A is automatically drawn outside the apparatus due to meshing between the rack 20c and the pinion as shown in FIG. 4. If the end portion 20d 1 of the actuator 20d reaches and passes the photosensor 38, the rotation of the motor 36 stops. At this stop position of the cassette 20A, the meshing between the pion 37 and the rack 20c disengages. Hence, the cassette 20A can be freely drawn from that position.

Thus, it is possible to easily recognize a failure in conveying the sheet 17 at a glance, and to urge a person present in the vicinity of the apparatus to restore the recording operation. Particularly in an image forming apparatus, such as a facsimile apparatus or the like, which operates even in an unmanned state, it is possible to increase operational efficiency of the apparatus by always detecting the state of conveying the sheet 17.

Figure 11:
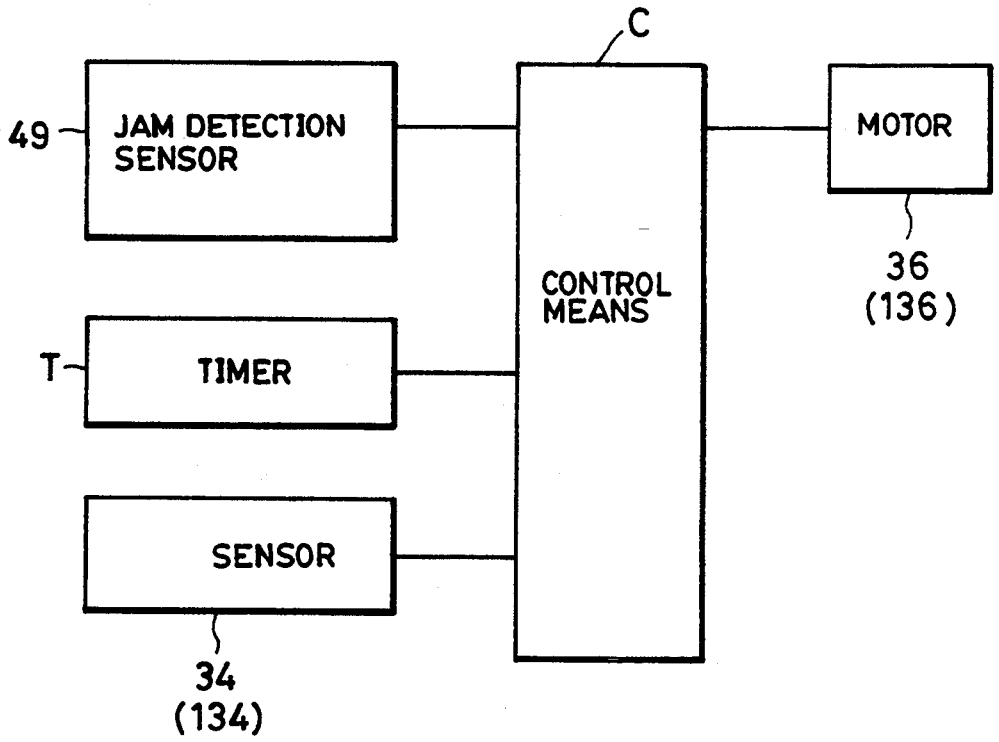
FIG. 11 is a block diagram of a control system for controlling an operation of drawing the cassette in the image forming apparatus shown in FIG. 6.

FIG. 11 is a block diagram of a control system. In FIG. 11, a control means C performs the above-described control by driving the motor 36 according to detection signals from the sensor 34 and the jam detection sensor 49, and a time counted by a timer T.

When all the sheets 17 are used up, a buzzer, display or the like may be used, either individually or together. It is desirable that the speed of drawing the cassette 20A outside the apparatus is relatively slow, and therefore the driving torque of the motor 36 is lower. This is for purpose of preventing an unforeseen accident when an object is present in the direction of drawing the cassette 20A from the main body of the apparatus.

Although in this embodiment the cassette 20A is drawn in the direction of the arrow shown in FIG. 4, the cassette 20A may also be drawn in the opposite direction. That is, the direction of drawing the cassette 20A may be parallel to the direction of feeding the sheet 17. If the cassette 20A is drawn in a direction perpendicular to the direction of feeding the sheet 17, a jammed sheet will be greatly deformed when the sheet is present, for example, in a nip portion between the cassette 20A, and the driving roller 23a and the pinch roller 23b, and the jam removing processing thereby becomes difficult.

If it is desired to draw the cassette 20A, not because of jamming, but for the purpose of confirming the remaining amount of the sheets 17, replenishing the sheets 17, exchanging the cassette 20A or the like, the cassette 20A may be drawn by depressing a button (not shown) provided on the operation panel D or in the vicinity of the cassette 20A to drive motor 36.

Figure 5:
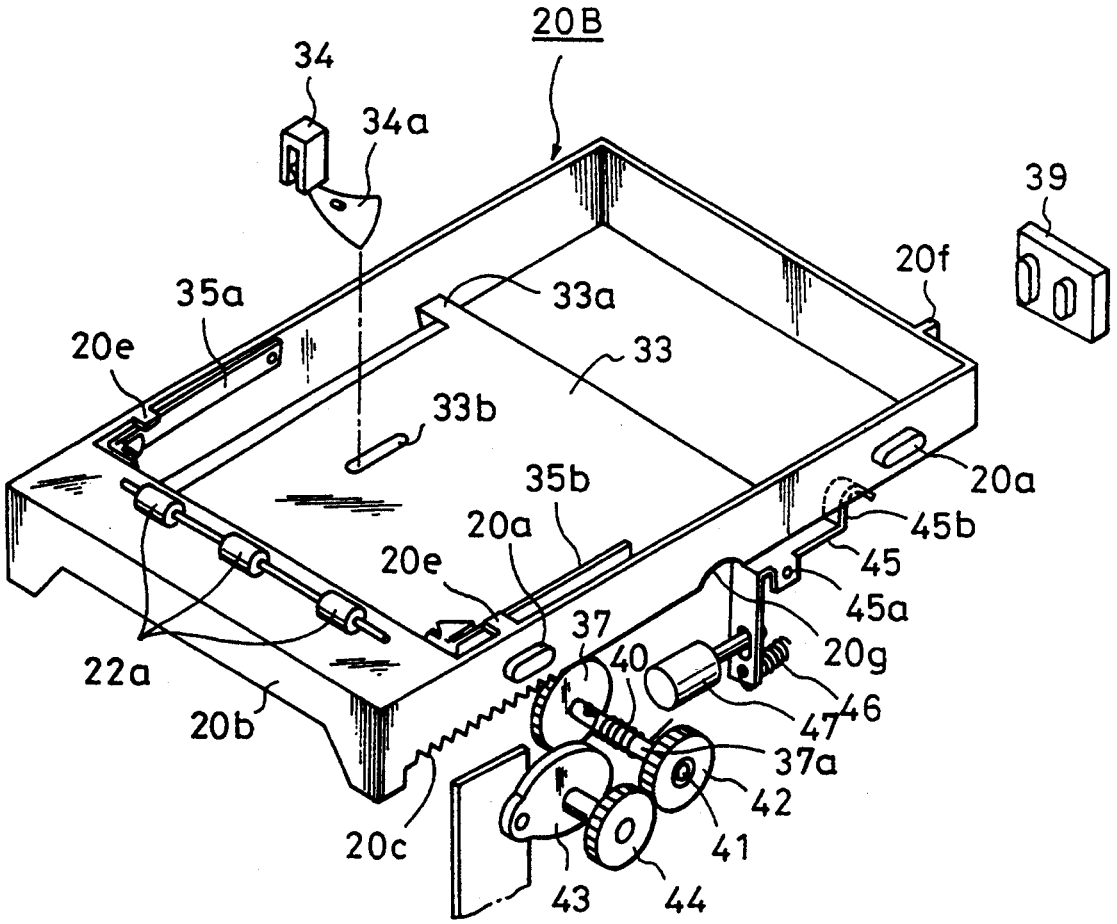
FIG. 5 is a perspective view showing another example of the cassette provided in the image forming apparatus shown in FIG. 1.

Next, an explanation will be provided of a cassette 20B according to a second embodiment of the present invention with reference to FIG. 5.

A motor is not used in the second embodiment. In FIG. 5, a coil spring 40 is wound around a rotation shaft 37a of a pinion 37, and a gear 42 is mounted at an end portion of the rotation shaft 37a via a one-way clutch 41. The gear 42 meshes a gear 44 connected to a torque limiter 43. One end of the coil spring 40 is fixed to the rotation shaft 37b. Another end of the coil spring 40 is drawn to the side of the main body of the apparatus, and engages an engaging member (not shown).

A recess 20g is provided at a predetermined position at a lower portion of a side of the cassette 20B. A hook member 45b formed at one end of a stopper 45 rotatably provided around a fulcrum 46a is provided so as to be engageable with the recess 20g. The hook member 45b engages the recess 20g to fix the cassette 20B when the cassette 20B is mounted in the cassette accommodating unit 32.

A spring 46 for driving the hook member 45b so as stay in pressure contact with the cassette 20B is connected to another end of the stopper 45. A solenoid 47 for rotating the stopper 45 against the elastic force of the spring 46 is connected to the stopper 45.

When accommodating the cassette 20B in the main body of the apparatus, the sheets 17 are set within the cassette 20B, and the cassette 20B is inserted into the cassette accommodating unit 32. The cassette 20B moves while slide projections 20a are guided by the guide grooves 32a. A rack 20c meshes the pinion 37, the rotation shaft 37a thereby rotates in a clockwise direction, and the coil spring 40 is wound to charge the elastic force. At that time, since the one-way clutch 41 is freed, the load of the torque limiter 43 is not applied. When the hook member 45b of the stopper 45 engages the recess 20g of the cassette 20B, mounting of the cassette 20B is completed. At that time, although a rotational force due to the elastic force from coil spring 40 is applied to the rotation shaft 37a of the pinion 37, the cassette 20B is locked in position due to engagement between the hook member 45b and the recess 20g.

If the jam detection sensor 49 detects jamming of the sheet 17 while being conveyed, the stopper 45 is rotated around the fulcrum 45a in a clockwise direction by turning on the solenoid 47, and engagement between the recess 20g and the hook member 45b is thereby released.

At that time, shaft 37a of the pinion 37 rotates in a counterclockwise direction due to the elastic force of the charged coil spring 40. However, the rotation of shaft 37a is gradual, since the one-way clutch 41 is locked to rotate the gear 42 and the gear 44 meshed therewith, whereby the load of the torque limiter 43 is applied. Accordingly, the cassette 20B is gradually moved outside the apparatus by meshing between the pinion 37 and the rack 20c. When the pinion 37 reaches the end portion of the rack 20c, the cassette 20B stops.

When manually drawing the cassette 20B, it is also possible to draw the cassette 20B by releasing engagement between the recess 20g and the hook member 45b by manually pulling a handle 20b (see FIG. 1). It is also possible to configure the apparatus so as to draw the cassette 20B by turning on the solenoid 47 by depressing a button (not shown) provided on the operation panel D or in the vicinity of the cassette 20B.

As described above, by automatically drawing the sheet mounting means outside the apparatus when jamming of a sheet occurs, it is possible to easily notify a person present in the vicinity of the image forming apparatus of a sheet conveyance failure, and thereby urge the person to restore the apparatus to its recording operation. Accordingly, in an image forming apparatus, such as a facsimile apparatus or the like, which may operate in an unmanned state, it is possible to increase operational efficiency of the apparatus by always detecting a state of conveying sheets.

Next, an explanation will be provided of a detection operation which detects when all of the sheets 17 within the cassette 20A, as shown in FIG. 3, are used up. When all the sheets 17 within the cassette 20A have been used up by copying operations, receiving operations or the like, the actuator 34a, which was in contact with the uppermost of sheets 17, drops into the hole 33b of the inside plate 33 to turn on the sensor 34 interrupted by the actuator 34*a*. Thus, the used-up state of the sheets 17 is detected.

At that time, if the motor 36 is rotated in a counterclockwise direction for a predetermined time period, the cassette 20A is automatically drawn outside the apparatus by meshing between the rack 20*a* and the pinion 37, as shown in FIG. 4.

Thus, it is possible to easily recognize the used-up state of the sheets 17, and to urge a person present in the vicinity of the apparatus to replenish the sheets 17. Particularly in an image forming apparatus, such as a facsimile apparatus or the like, which operates even in an unmanned state, it is possible to increase operational efficiency of the apparatus by making the sheets 17 always in a loaded state.

Next, an explanation will be provided of a detection operation for when all the sheets 17 within the cassette 208 shown in FIG. 5 are used up.

When accommodating the cassette 20B in the main body of the apparatus, the sheets 17 are set within the cassette 20B, and the cassette 20B is inserted into the cassette accommodating unit 32. The cassette 20B moves while the slide projections 20*a* are guided by the guide grooves 32*a*. The rack 20*c* meshes the pinion 37, the rotation shaft 37*a* thereby rotates in a clockwise direction, and the coil spring 40 is wound to charge the elastic force. At that time, since the one-way clutch 41 is freed, the load of the torque limiter 43 is not applied. When the hook member 45*b* of the stopper 45 engages the recess 20*g* of the cassette 20B, mounting of the cassette 20B is completed. At that time, although a rotational force due to the elastic force charged by the coil spring 40 is applied to the rotation shaft 37*a* of the pinion 37, the cassette 20B is fixed without moving to the outside due to engagement between the hook member 45*b* and the recess 20*g*.

If a used-up state of the sheets 17 within the cassette 20B is detected by the sensor 34 being turned on, the stopper 45 is rotated around the fulcrum 45*a* in a clockwise direction by turning on the solenoid 47 to release engagement between the recess 20*g* and the hook member 45*b*.

At that time, the rotation shaft 37*a* of the pinion 37 rotates in a counterclockwise direction due to the elastic force of the charged coil spring 40. However, the rotation shaft 37*a* rotates gradually, since the one-way clutch 41 is locked to rotate the gear 42 and the gear 44 meshed therewith, whereby the load of the torque limiter 43 is applied. Accordingly, the cassette 20B is automatically drawn while gradually moving outside the apparatus by meshing between the pinion 37 and the rack 20*c*. When the pinion 37 reaches the end portion of the rack 20*c*, the cassette 20B stops.

When manually drawing out the cassette 20B, it is also possible to release engagement between the recess 20*g* and the hook member 45*b* by manually pulling the handle 20*b*. Alternatively, the cassette 20B may be removed by turning on the solenoid 47 by depressing a button (not shown) provided on the operation panel D or in the vicinity of the cassette 20B.

As described above, by automatically drawing the sheet mounting means outside the apparatus when a used-up state of sheets in the sheet mounting means is detected, it is possible to easily notify a person present in the vicinity of the image forming apparatus of the used-up state of the sheets, and thereby to urge the person to replenish the recording sheets.

Accordingly, in an image forming apparatus, such as a facsimile apparatus or the like, which may operate in an unmanned state, it is possible to increase operational efficiency of the apparatus by always securing recording sheets.

Next, an explanation will be provided of an image forming apparatus according to a third embodiment of the present invention with reference to FIGS. 6–10.

In the present embodiment, the direction of drawing a cassette from the main body of the apparatus differs from the direction in the first and second embodiments. In FIGS. 6–10, like components as those in the first embodiment are indicated by like numerals, and explanation thereof will be omitted.

Figure 6:
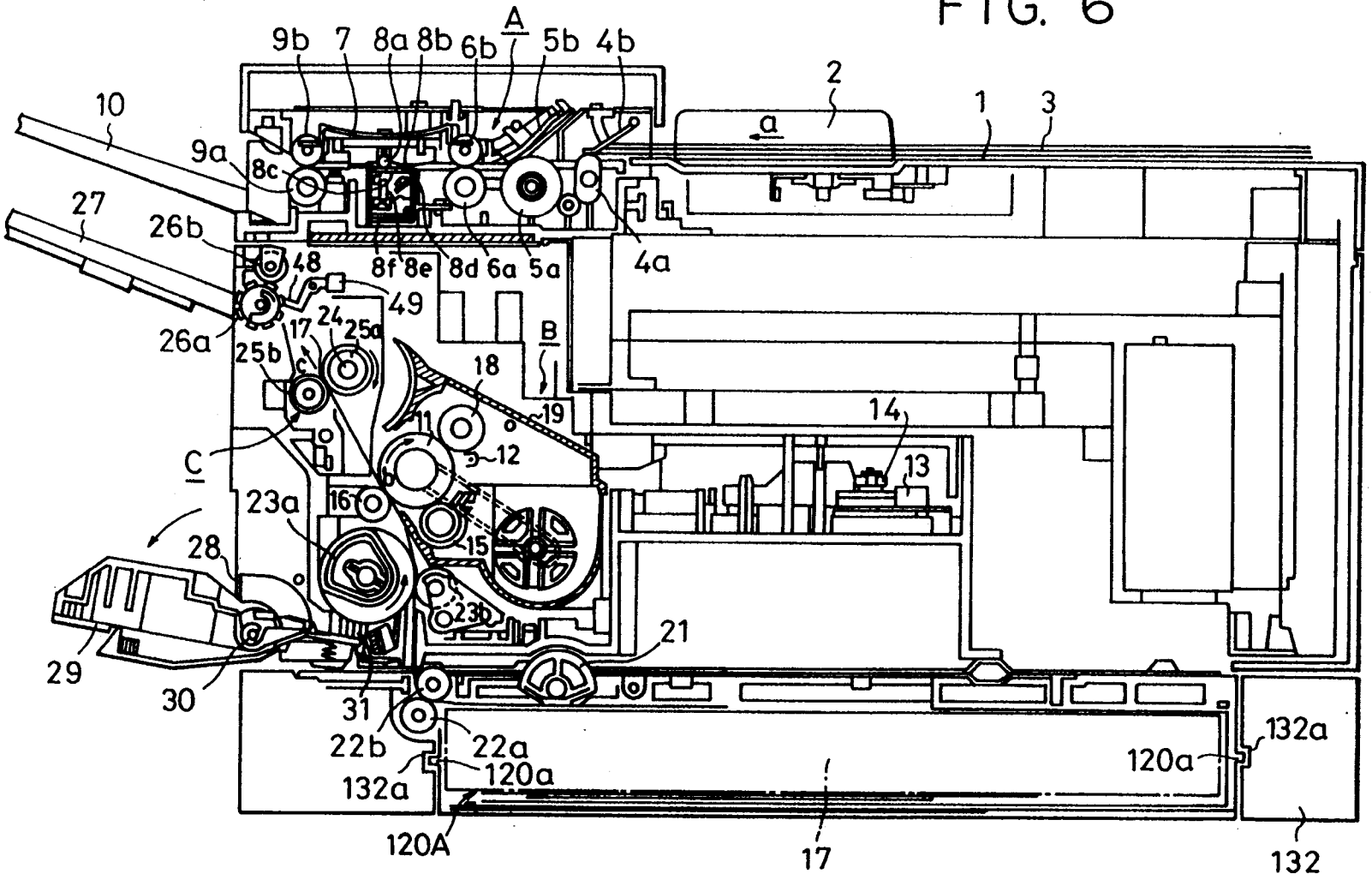
FIG. 6 is a vertical cross-sectional view of an image forming apparatus according to another embodiment of the present invention.
Figure 7:
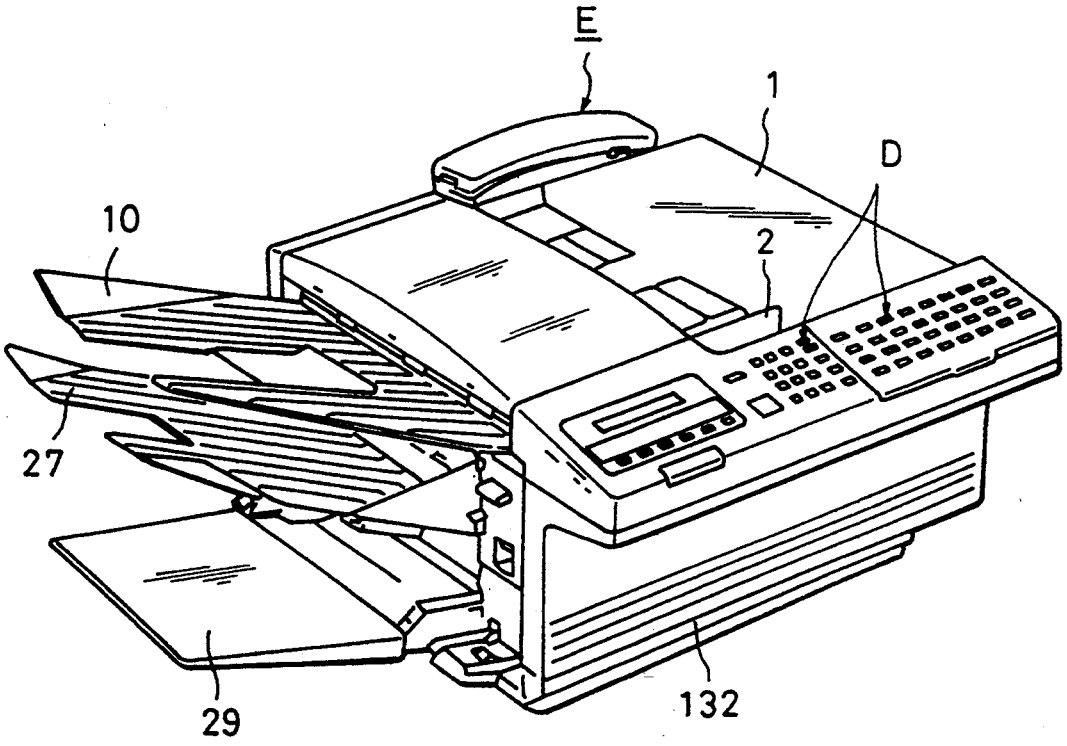
FIG. 7 is a perspective view of the entire image forming apparatus shown in FIG. 6.

As shown in FIG. 6, a cassette 120A is accommodated in a lower portion of the main body of the apparatus so as to be drawable forwardly from the plane of FIG. 6, and slide projections 120*a* protrude at the both outer sides of the receptacle of cassette 20A. A cassette accommodating unit 132 having an opening is formed at a central portion of a lower portion of the apparatus. Guide grooves 132*a*, in which the slide projections 120*a* can be slidably fitted, are formed in the right and left inner walls of the cassette accommodating unit 132.

Accordingly, the cassette 120A can be set by fitting the slide projections 120*a* into the guide grooves 132*a* from the opening formed at the central portion in FIG. 6. The cassette 120A can be taken out by grasping a handle 120*b* (see FIG. 8) formed on the cassette 120A and drawing the cassette 120A forward side from the plane of FIG. 6.

Figure 8:
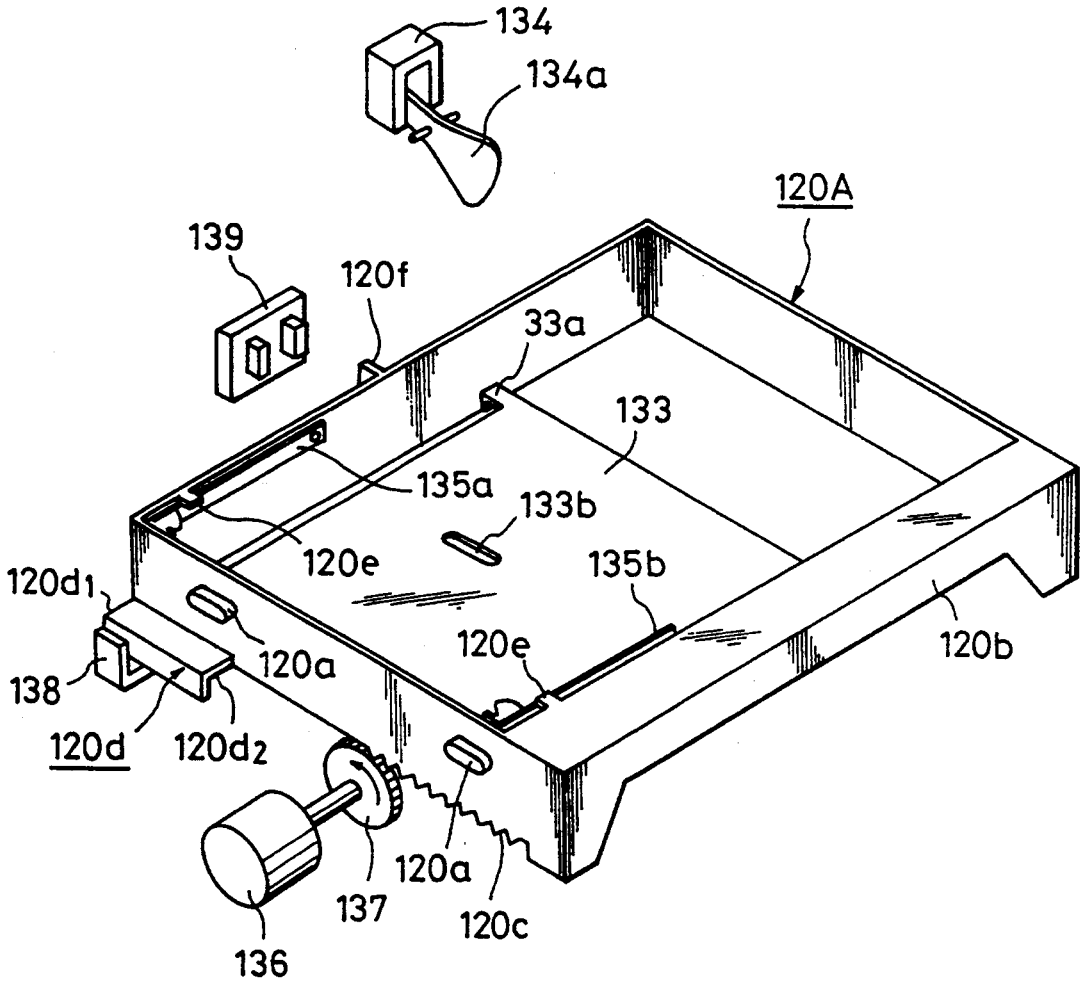
FIG. 8 is a perspective view of a cassette provided in the image forming apparatus shown in FIG. 6.

Next, the structure of the cassette 120A will be explained in detail with reference to FIG. 8. An inside plate 133 for mounting the sheets 17 is provided so as to be rotatable around a fulcrum 133*a* at a base portion of the cassette 120A. The inside plate 133 is configured so as to be upwardly driven from the back side by a lever or the like (not shown) when the cassette 120A is inserted into the cassette accommodating unit 132.

A sensor 134 detects the presence/absence of the sheets 17 mounted on the inside plate 133. An actuator 134*a* for the sensor 134 rests in contact with the uppermost of the sheets 17 mounted on the inside plate 33 and interrupting the sensor 134 (an off-state). A hole 133*b* is provided at a predetermined position of the inside plate 133. When all the sheets 17 on the inside plate 133 are used up, the actuator 134*a* drops into the hole 133*b*, whereby the sensor 134 is turned on, and the absence of the sheets 17 can be thereby detected. The sheets 17 mounted on the inside plate 133 are individually separated and fed from the uppermost sheet by separation pieces 135*a* and 135*b* and stoppers 120*e* provided at inner walls of the cassette 120A.

A rack 120*c* is formed at a lower portion of a side of the cassette 120A, and a pinion 137 rotatably driven by a motor 136 meshes the rack 120*c*. By rotating the motor 136 in the forward or reverse direction, the cassette 120A can be drawn from or accommodated in the main body of the apparatus. An actuator 120*d* having an L-shaped cross section protrudes over a predetermined length (from end portion $120d_1$ to end portion $120d_2$) at a side of the cassette 120A. A photosensor 138 is provided in the moving range of the actuator 120*d*.

A projection 120*f* protrudes at the rear side of the cassette 120A, and a sensor 139 for determining the size (the B4 size, the A4 size or the like) of the cassette is provided at a position corresponding to the projection 120*f*.

When accommodating the cassette 120A in the main body of the apparatus, the sheets 17 are set within the cassette 120A, and the cassette 120A is inserted into the cassette accommodating unit 132. The cassette 120A moves while the slide projections **120*a* are guided by the guide grooves 132*a*. If the end portion 120*d*$_1$ of the actuator 120*d* reaches the photosensor 138, the motor 136 rotates in a counterclockwise direction. If the cassette 120A is partially inserted into the cassette accommodating unit 132, the rack 120*c* meshes the pinion 137, whereupon insertion of the cassette 120A is automatically completed. If the cassette 120A moves and the end portion 120*d*$_2$ of the actuator 120*d* reaches the photosensor 138, the projection 120*f* contacts the sensor 139, and the movement of the cassette 120A stops. At that time, since a rotational load from the motor 136 is applied to the cassette 120A, the cassette 120A is fixed without running out of the cassette accommodating unit 132 due to a reaction. Although, in the present embodiment, the cassette 120A is fixed in position after being mounted on the cassette accommodating unit 132 by the load of the motor 136, the cassette 120A** may also be fixed by providing a fixing means utilizing, for example, engagement between a leaf spring and a recess.

Next, an explanation will be provided of the relationship between the detection operation of the sheets 17 and the drawing operation of the cassette 120A.

If all the sheets 17 within the cassette 120A are used up due to copying operations or receiving operations, the actuator **134*a*, which has interrupted the sensor 134 by contacting the sheets 17, drops into the hole 133*b* to turn on the sensor 134, and it is thereby determined that all the sheets 17** have been used up.

If the time for conveying the sheet 17 from starting the feed roller 21 until the sheet 17 reaches the jam detection actuator 48 exceeds a predetermined time, it is determined that the sheet 17 is not fed from the cassette 120A, or jamming occurs in the image transfer or fixing process. If the turning-on time of the jam detection sensor 49 exceeds a time corresponding to the length of the sheet 17 from a size detection signal of the cassette 120A, it is determined that jamming of the sheet 17 occurs in the discharging operation.

Figure 9:
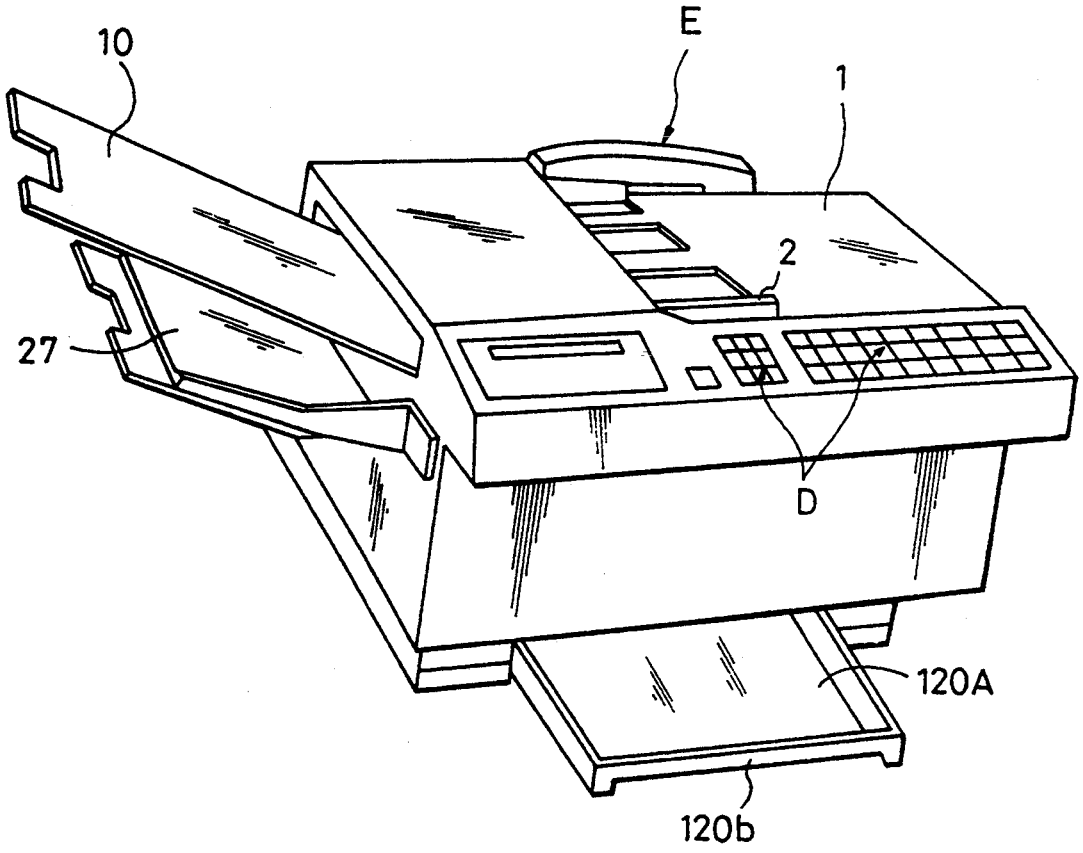
FIG. 9 is a perspective view showing a state of the cassette shown in FIG. 8 drawn from the main body of the apparatus.

For example, when the rear end of the last sheet 17 within the cassette 120A has passed the actuator **134*a* to turn on the sensor 134, it is determined that "all the sheets 17 have been used up". When the rear end of the sheet 17 has passed the jam detection actuator 48 at a predetermined timing, it is determined that "jamming has not occurred". At that time, if the motor 136 is rotated in a clockwise direction for a predetermined time period, the cassette 120A is automatically drawn outside the apparatus due to meshing between the rack 120*c* and the pinion 137, as shown in FIG. 9**.

Thus, it is possible to recognize a used-up state of the sheets 17 at a lance, and to urge a person present in the vicinity of the apparatus to replenish the sheets 17. Particularly in an image forming apparatus, such as a facsimile apparatus or the like, which operates even in an unmanned state, it is possible to increase operational efficiency of the apparatus.

By detecting the position of the rear end of the sheet 17 by the jam detection sensor 49 before drawing the cassette 120A, it is possible to prevent damage or additional jamming caused by the sheet 17 remaining in the moving region of the cassette 120A and to thereby increase safety.

When all the sheets 17 are used up, a buzzer, display or the like may also be used together. It is desirable that the speed of drawing the cassette 120A outside the apparatus is slower, and the driving torque of the motor 136 is lower. This is for the purpose of preventing an accident when an object is present in the direction of drawing the cassette 120A from the main body of the apparatus.

When the cassette 120A is drawn not for processing jamming of the sheet 17, but for the purpose of confirming the remaining amount of the sheets 17, replenishing the sheets 17, exchanging the cassette 120A, or the like, the cassette 120A can be drawn by driving the motor 136 by depressing a button (not shown) provided on panel D or in the vicinity of the cassette 120A. Also in this case, the cassette 120A is moved after confirming that the rear end of the sheet 17 is not in the mounting-/demounting region of the cassette 120A by the jam detection sensor 49.

Although the jam detection means is disposed in the vicinity of the pair of discharging rollers **26*a* and 26*b*, the position of the jam detection means is not limited to this position, but the jam detection means may be disposed in the vicinity of the pair of conveyance rollers 23*a* and 23*b***. Alternatively, any other detection means may also be used as the jam detection means.

Figure 10:
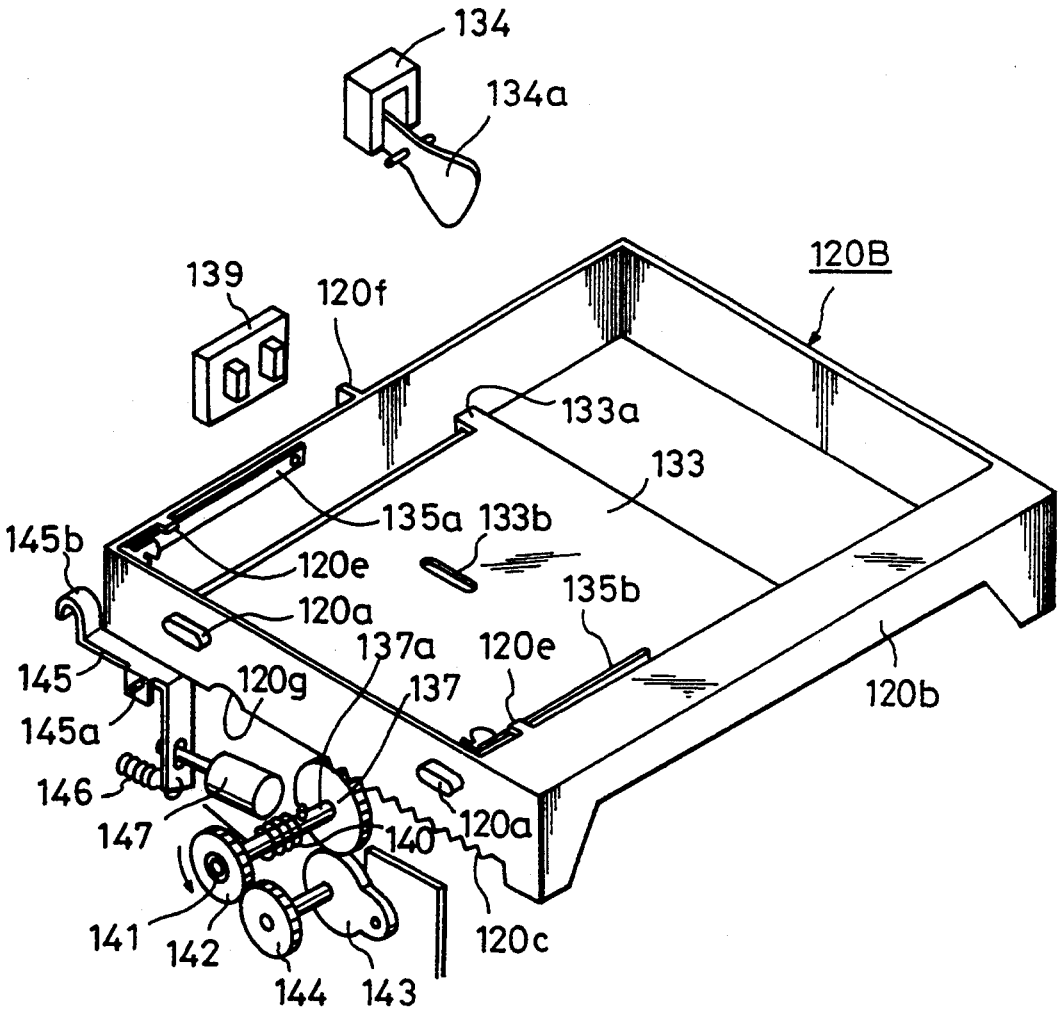
FIG. 10 is a perspective view of another example of the cassette provided in the image forming apparatus shown in FIG. 6.

Next, an explanation will be provided of a cassette 120B according to another embodiment of the present invention with reference to FIG. 10.

A motor is not used in the present embodiment. In FIG. 10, a coil spring 140 is wound around a rotation shaft **137*a* of a pinion 137, and a gear 142 is mounted at an end portion of the rotation shaft 137*a* via a one-way clutch 141. The gear 142 meshes a gear 144 connected to a torque limiter 143. One end of the coil spring 140 is fixed to the rotation shaft 137*b*. Another end of the coil spring 140** is drawn to the side of the main body of the apparatus, and engages an engaging member (not shown).

A recess **120*g* is provided at a predetermined position at a lower portion of a side of the cassette 120B. A hook member 145*b* formed at one end of a stopper 145 rotatably provided around a fulcrum 145*a* is provided so as to be engeable with the recess 120*g*. The hook member 145*b* engages the recess 120*g* to fix the cassette 120B when the cassette 120B is mounted in the cassette accommodating unit 132**.

A spring 146 for driving the hook member **145*b* so as to stay in pressure contact with the cassette 120B is connected to another end of the stopper 145. A solenoid 147 for rotating the stopper 145 against the elastic force of the spring 146 is connected to the stopper 145**.

When accommodating the cassette 120B in the main body of the apparatus, the sheets 17 are set within the cassette 120B, and the cassette 120B is inserted into the cassette accommodating unit 132. The cassette 120B moves while slide projections **120*a* are guided by the guide grooves 132*a*. A rack 120*c* meshes the pinion 137, the rotation shaft 137*a* thereby rotates in a counterclockwise direction, and the coil spring 140 is wound to charge the elastic force. At that time, since the one-way clutch 141 is freed, the load of the torque limiter 143 is not applied. When the hook member 145*b* of the stopper 145 engages the recess 120*g* of the cassette 120B, mounting of the cassette 120B is completed. At that time, although a rotational force due to the elastic force charged by the coil spring 140 is applied to the rotation shaft 137*a* of the pinion 137, the cassette 120B is fixed without moving to the outside due to engagement between the hook member 145b and the recess 120g**.

When the jam detection sensor 49 has detected the rear end of the sheet 17 when all the sheets 17 within the cassette 120B have been used up, or jamming of the sheet 17 has occurred, the stopper 145 is rotated around the fulcrum 145a in a clockwise direction by turning on the solenoid 147 to release engagement between the recess 120g and the hook member 145b.

At that time, the rotation shaft 137a of the pinion 137 rotates in a clockwise direction due to the elastic force of the charged coil spring 140. However, the rotation shaft 137a rotates gradually, since the one-way clutch 141 is locked to rotate the gear 142 and the gear 144 meshed therewith, whereby the load of the torque limiter 143 is applied. Accordingly, the cassette 120B is automatically drawn while gradually moving outside the apparatus by meshing between the pinion 137 and the rack 120c. When the pinion 137 reaches the end portion of the rack 120c, the cassette 120B stops.

When manually drawing the cassette 120B, it is also possible to draw the cassette 120B out of the apparatus by releasing engagement between the recess 120g and the hook member 145b by manually pulling a handle 120b. It is also possible to configure the apparatus so as to draw the cassette 120B out of the apparatus by turning on the solenoid 147 by depressing a button (not shown) provided on the operation panel D or in the vicinity of the cassette 120B.

The position of the jam detection sensor 49 is not limited to the position in the present embodiment, provided that the position is on the conveying path of the sheet 17 and not in the moving region of the cassette 120B. It is desirable, however, that the cassette 120B is moved after the completion of the transfer process or the fixing process.

In the third embodiment, according to the size of the sheet 17, the rear end of the sheet 17 is in some cases not in the mounting/demounting region of the cassette 120A even when the jam detection sensor 49 has detected the sheet 17. In such a case, it is possible to move the cassette 120A. Accordingly, a detection means for detecting jamming while the sheet 17 is fed may be provided in the vicinity of the mounting/demounting region of the cassette 120A in addition to the jam detection sensor 49, and the cassette 120A may be moved if the detection means does not detect the sheet 17 when the sheet 17 has produced jamming.

In the first and second embodiments, since the direction of feeding the sheet 17 and the moving direction of the cassette 20A are the same, occurrence of damage is rare even if the cassette 20A is moved when the sheet 17 has, jammed while being fed. However, if a detection means for detecting jamming while the sheet 17 is fed is provided so as to move the cassette 20A if the detection means does not detect the sheet 17 when the sheet 17 has produced jamming, it is possible to securely prevent damage of the sheet 17, or the like.

As described above, by automatically drawing a sheet mounting means outside an image forming apparatus when all the sheets within the sheet mounting means are used up, or when jamming occurs in a sheet fed from the sheet mounting means, it is possible to easily notify a person present in the vicinity of the apparatus of a used-up state of the sheets or a failure in conveying the sheet. Hence, by thereby urging an operation to restore the apparatus, it is possible to increase recording efficiency.

In addition, by drawing the sheet mounting means after confirming that the rear end of the sheet is not in the moving region of the sheet mounting means, it is possible to prevent troubles, such that the sheet is damaged, whereby, for example, it becomes difficult to take out the sheet, or the apparatus is damaged, and to thereby increase safety.

The present invention is not limited to the above-described embodiments. For example, while a pinion and a rack are used as means for moving a cassette, an endless belt and a pulley may be used, or any other combination may be used provided that it can move the cassette.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. An image forming apparatus, comprising:

sheet mounting means for accommodating sheets;

moving means for automatically moving said sheet mounting means between a feed position within a main body of said image forming apparatus for feeding a sheet and a drawn position wherein said sheet mounting means is drawn from the main body of said image forming apparatus;

image forming means for forming an image on the sheet;

discharge means for discharging the sheet on which an image is formed by said image forming means;

conveying means for feeding and conveying a sheet from said sheet mounting means at the feed position to said discharge means;

jam detection means for detecting that the sheet being conveyed by said conveying means has jammed; and sheet detection means for detecting a stoppage of the sheet being conveyed before the sheet is completely fed from said sheet mounting means; and control means for controlling said moving means to automatically move said sheet mounting means from the feed position to the drawn position when said jam detection means has detected that the sheet has jammed and said sheet detection means does not detect stoppage of the sheet, and for inhibiting movement of said sheet mounting means when said sheet detection means has detected stoppage of the sheet.

2. An apparatus according to claim 1, wherein said moving means moves said sheet mounting means in a direction traverse to the sheet feeding direction, and said sheet detection means comprises jam detection means for detecting that the sheet has jammed before the sheet is completely fed from said sheet mounting means.

3. An apparatus according to claim 1, wherein said moving means comprises a motor which generates a rotational driving force to move said sheet mounting means between the feed position and the drawn position.

4. An apparatus according to claim 3, wherein said moving means comprises a pinion provided on a driving shaft of said motor and a rack provided on said sheet mounting means meshing said pinion, and wherein said sheet mounting means moves via said pinion and said rack by rotation of said motor.

5. An apparatus according to claim 3, wherein said moving means further comprises detection means for detecting a position of said sheet mounting means in order to stop said motor when said sheet mounting means has moved to at least one of the feed position and the drawn position.

6. An apparatus according to claim 3, wherein said driving means further comprises switching means for rotating said motor in order to move said sheet mounting means from the feed position to the drawn position.

7. An image forming apparatus, comprising:

sheet mounting means for accommodating sheets;

moving means for automatically moving said sheet mounting means between a feed position within a main body of said image forming apparatus for feeding a sheet and a drawn position wherein said sheet mounting means is drawn from the main body of said image forming apparatus, wherein said moving means comprises a spring for generating a force to move said sheet mounting means by an elastic force;

image forming means for forming an image on the sheet;

discharge means for discharging the sheet on which an image is formed by said image forming means;

conveying means for feeding and conveying a sheet from said sheet mounting means at the feed position to said discharge means;

sheet detection means for detecting a stoppage of the sheet being conveyed by said conveying means; and control means for controlling said moving means to automatically move said sheet mounting means from the feed position to the drawn position according to a detection by said sheet detection means.

8. An apparatus according to claim 7, wherein the elastic force of said spring is charged when said sheet mounting means is moved from the drawn position to the feed position, and wherein the sheet mounting means is moved to said drawn position when the charged elastic force of said spring is released.

9. An apparatus according to claim 8, wherein said moving means further comprises locking means for locking said sheet mounting means when said sheet mounting means is at the feed position, and wherein said sheet mounting means is moved to the drawn position by the charged elastic force of said spring when said locking means is released.

10. An apparatus according to claim 9, wherein said moving means further comprises a torque limiter for adding a load when the charged elastic force of said spring is released, and wherein said sheet mounting means is moved to the drawn position at a low speed by the load of said torque limiter.

11. An image forming apparatus, comprising:

sheet mounting means for accommodating sheets;

moving means for automatically moving said sheet mounting means between a feed position within a main body of said image forming apparatus for feeding a sheet and a drawn position wherein said sheet mounting means is drawn from the main body of said image forming apparatus, wherein said mounting means is drawn by said moving means in the same direction as a direction of feeding of the sheet from said sheet mounting means;

image forming means for forming an image on the sheet;

discharge means for discharging the sheet on which an image is formed by said image forming means;

conveying means for feeding and conveying a sheet from said sheet mounting means at the feed position to said discharge means;

sheet detection means for detecting a stoppage of the sheet being conveyed by said conveying means; and control means for controlling said moving means to automatically move said sheet mounting means from the feed position to the drawn position upon a detection by said sheet detection means.

12. An apparatus according to claim 11, wherein the direction of drawing said sheet mounting means is at an operational side of the image forming apparatus.

13. An image forming apparatus, comprising:

sheet mounting means for accommodating sheets;

remaining-amount detection means for detecting a remaining amount of the sheets accommodated in said sheet mounting means;

moving means for moving said sheet mounting means between a feed position within a main body of said image forming apparatus for feeding out a sheet in a sheet feeding direction, and a drawn position wherein said sheet mounting means is drawn from the main body of said image forming apparatus in a direction traverse relative to the sheet feeding direction;

image forming means for forming an image on a sheet fed from said sheet mounting means;

conveying means for feeding and conveying a sheet from said sheet mounting means at the feed position to said image forming means;

sheet detection means for detecting a stoppage of the sheet being conveyed before the sheet is completely fed from said sheet mounting means; and control means for controlling said moving means to move said sheet mounting means from the feed position to the drawn position when said remaining-amount detection means has detected that the remaining amount of the sheets accommodated in said sheet mounting means equals a predetermined amount and said sheet detection means does not detect stoppage of the sheet, and for inhibiting movement of said sheet mounting means if said sheet detection means has detected stoppage of the sheet.

14. An apparatus according to claim 13, wherein said remaining-amount detection means detects an absence of sheets accommodated in said sheet mounting means.

15. An apparatus according to claim 14, wherein said sheet detection means comprises jam detection means for detecting that the sheet has jammed while being fed from said sheet mounting means.

16. An apparatus according to claim 15, wherein said control means moves said sheet mounting means from the feed position to the drawn position by operating said moving means if said jam detection means does not detect jamming when said remaining-amount detection means has detected an absence of sheets, and inhibits movement of said sheet mounting means when said jam detection means has detected jamming.

17. An apparatus according to claim 13, wherein said moving means moves said sheet mounting means between the feed position and the drawn position by a rotational driving force of a motor.

18. An apparatus according to claim 17, wherein said moving means comprises a pinion provided on a driving shaft of said motor and a rack provided on said sheet mounting means meshing said pinion, and wherein said sheet mounting means moves via said pinion and said rack by rotation of said motor.

19. An apparatus according to claim 17, wherein said moving means further comprises detection means for detecting a position of said sheet mounting means in order to stop said motor when said sheet mounting means has moved to at least one of the feed position and the drawn position.

20. An apparatus according to claim 17, wherein said moving means further comprises switching means for rotating said motor in order to move said sheet mounting means from the feed position to the drawn position.

21. An apparatus according to claim 13, wherein said moving means moves said sheet mounting means from the feed position to the drawn position by an elastic force of a spring.

22. An apparatus according to claim 21, wherein the elastic force of said spring is charged when said sheet mounting means is moved from the drawn position to the feed position, and wherein said sheet mounting means is moved from the drawn position when the charged elastic force of said spring is released.

23. An apparatus according to claim 22, wherein said moving means further comprises locking means for locking said sheet mounting means when said sheet mounting means is at the feed position, and wherein said sheet mounting means is moved to the drawn position by the charged elastic force of said spring when said locking means is released.

24. An apparatus according to claim 23, wherein said moving means further comprises a torque limiter for adding a load when the charged elastic force of said spring is released, and wherein said sheet mounting means is moved to the drawn position at a low speed by the load of said torque limiter.

25. An image forming apparatus, comprising:

sheet mounting means movably provided between a feed position within a main body of said image forming apparatus for feeding an accommodated sheet, and a drawn position wherein said sheet mounting means is drawn from the main body of said image forming apparatus;

moving means for automatically moving said sheet mounting means between the feed position and the drawn position, said moving means using a driving force of an electric rotation driving means;

remaining-amount detection means for detecting a remaining amount of sheets accommodated in said sheet mounting means;

image forming means for forming an image on the sheet fed from said sheet mounting means;

conveying means for feeding and conveying a sheet from said sheet mounting means at the feed position to said image forming means; and control means for controlling said moving means to move said sheet mounting means from the feed position to the drawn position when said remaining-amount detection means has detected that the remaining amount of the sheets accommodated in said sheet mounting means equals a predetermined amount.

26. An apparatus according to claim 25, wherein said electric rotation driving means comprises a motor.

27. An apparatus according to claim 26, wherein said moving means comprises a pinion provided on a driving shaft of said motor and a rack provided on said sheet mounting means meshing said pinion, and wherein said sheet mounting means moves via said pinion and said rack by rotation of said motor.

28. An apparatus according to claim 27, wherein meshing between said pinion and said rack is disengaged at the drawn position, thereby allowing said sheet mounting means to be manually drawn.

29. An image forming apparatus, comprising:

sheet mounting means movably provided between a feed position within a main body of said image forming apparatus for feeding an accommodated sheet, and a drawn position wherein said sheet mounting means is drawn from the main body of said image forming apparatus;

moving means for automatically moving said sheet mounting means from the feed position to the drawn position by releasing an elastic force of a spring in a torsional direction thereof, said spring having been charged when said sheet mounting means is pressed from the drawn position to the feed position;

remaining-amount detection means for detecting a remaining amount of sheets accommodated in said sheet mounting means;

image forming means for forming an image on the sheet fed from said sheet mounting means;

conveying means for feeding and conveying a sheet from said sheet mounting means at the feed position to said image forming means; and control means for controlling said moving means to move said sheet mounting means from the feed position to the drawn position when said remaining-amount detection means has detected that the remaining amount of the sheets accommodated in said sheet mounting means equals a predetermined amount.

30. An apparatus according to claim 29, wherein one end of said spring is secured to a driving shaft to which a pinion is connected, another end of said spring is secured to a main body of said image forming apparatus, and a rack provided on said sheet mounting means meshes said pinion, wherein the elastic force is charged by displacing said spring in the tortional direction thereof via said rack and said pinion when said sheet mounting means is pressed from the drawn position to the feed position, and wherein said sheet mounting means is moved to the drawn position via said pinion and said rack by rotation of said driving shaft by releasing the charged elastic force.

31. An apparatus according to claim 30, further comprising locking means for locking said sheet mounting means at the feed position.

32. An apparatus according to claim 31, wherein meshing between said pinion and said rack is disengaged at the drawn position, thereby allowing said sheet mounting means to be manually drawn.

33. An apparatus according to claim 32, wherein said moving means further comprises a torque limiter for adding a load when the charged elastic force of said spring is released, and wherein said sheet mounting means is moved to the drawn position at a low speed by the load of said torque limiter.

* * * * *

UNITED STATES PATENT AND TRADEMARK OFFICE

CERTIFICATE OF CORRECTION

PATENT NO. : 5,384,624

DATED : January 24, 1995

INVENTOR(S) : NORIO KAJIWARA

It is certified that error appears in the above-indentified patent and that said Letters Patent is hereby corrected as shown below:

On the title page, item [56], "Waka(ℓ)" should read --Wakao--;

"5,126,989 6/1992 Fukuchi et al." should read --5,126,789 6/1992 Fukuchi et al.".

Column 1,
line 51, "ApF" should read --ADF--; and
line 65, "all" should read --a--.

Column 4,
line 14, "udder" should read --upper--; and
line 19, "dressing" should read --pressing--.

Column 6,
line 40, "projetions" should read --projections--; and
line 47, "$20d_2$of" should read --$20d_2$ of--.

Column 7,
line 1, "sheet 17" should read --sheet 17 is--;
line 10, "pion" should read --pinion--; and
line 30, "for" should read --for the--.

Column 9,
line 19, 208" should read --20B--.

UNITED STATES PATENT AND TRADEMARK OFFICE

CERTIFICATE OF CORRECTION

PATENT NO. : 5,384,624

DATED : January 24, 1995

INVENTOR(S) : NORIO KAJIWARA

It is certified that error appears in the above-indentified patent and that said Letters Patent is hereby corrected as shown below:

Column 10,
line 30, "side" should be deleted.

Column 15,
line 42, "the" (second occurrence) should read --said--; and
line 43, "said" should read --the--.

Column 17,
line 26, "from" should read --to--.

Signed and Sealed this

Second Day of May, 1995

Bruce Lehman

BRUCE LEHMAN

*Commissioner of Patents and Trademarks*

*Attest:*

*Attesting Officer*